United States Patent [19]

Rutledge

[11] Patent Number: 4,817,343

[45] Date of Patent: Apr. 4, 1989

[54] LEAK-PROOF CEILING SYSTEM

[76] Inventor: B. G. Rutledge, 5667 Rensslaer, Bartlett, Tenn. 38134

[21] Appl. No.: 104,648

[22] Filed: Oct. 5, 1987

[51] Int. Cl.[4] ..... E04B 5/52; E04D 13/00

[52] U.S. Cl. ..... 52/22; 52/14

[58] Field of Search ..... 52/11–16, 52/22, 484, 488, 489

[56] References Cited

U.S. PATENT DOCUMENTS

| | | | |
|---|---|---|---|
| 1,000,887 | 8/1911 | Beamish | 52/14 X |
| 2,688,291 | 9/1954 | Cannard | 52/14 |
| 3,488,905 | 1/1970 | Cambell | 52/14 X |
| 3,611,649 | 10/1971 | Muller et al. | 52/14 X |
| 4,009,541 | 3/1977 | Yoneya | 52/14 |
| 4,401,165 | 8/1983 | Gutermuth et al. | 52/14 X |

FOREIGN PATENT DOCUMENTS

| | | | |
|---|---|---|---|
| 7922 | 2/1980 | European Pat. Off. | 52/22 |
| 1247598 | 8/1967 | Fed. Rep. of Germany | 52/14 |
| 2712592 | 10/1977 | Fed. Rep. of Germany | 52/14 |
| 3507306 | 8/1986 | Fed. Rep. of Germany | 52/14 |
| 253729 | 7/1927 | Italy | 52/14 |

*Primary Examiner*—D. A. Scherbel
*Assistant Examiner*—Richard E. Chilcot, Jr.
*Attorney, Agent, or Firm*—Walker & McKenzie

[57] ABSTRACT

A leak-proof ceiling structure associated with a roof to define a protected space beneath the roof and to prevent any liquid which may leak through the roof from passing to the protected space. A pair of elongated longerons are suspended beneath the roof with each of the longerons spaced apart from the other with the second end of the longerons higher than the first end thereof. Elongated troughs are suspended between the pair of longerons for catching liquid that may leak from the roof.

13 Claims, 3 Drawing Sheets

LEAK-PROOF CEILING SYSTEM

BACKGROUND OF THE INVENTION

1. Field of the Invention

The present invention relates, in general, to a ceiling system for preventing water, and the like, from leaking through the ceiling into the interior of a room or the like.

2. Description of the Related Art

A preliminary patentability seach conducted in class 52, subclasses 13, 14 and 484 disclosed the following patents: Beamish, U.S. Pat. No. 1,000,887; Campbell, U.S. Pat. No. 3,488,905; Muller et al, U.S. Pat, No. 3,611,649; Yoneya, U.S. Pat. No. 4,009,541; and Gutermuth et al, U.S. Pat. No. 4,401,165. None of the above patents disclose or suggest the present invention.

SUMMARY OF THE INVENTION

The present invention is directed toward providing a leak-proof ceiling structure for being associated with a roof to protect a specific space or area beneath the roof from any liquid which may leak through the roof. The protected space may be used to house computer data and equipment or any other moisture-sensitive material and the like.

The leak-proof ceiling structure of the present invention includes, in general, a pair of longerons; suspension means for suspending the longerons beneath the roof structure with the longerons spaced from one another; and trough means for being suspended between the pair of longerons and for catching any liquid that may leak from the roof and for conveying any such liquid away from the protected space.

DESCRIPTION OF THE PREFERRED EMBODIMENT

Figure 1:
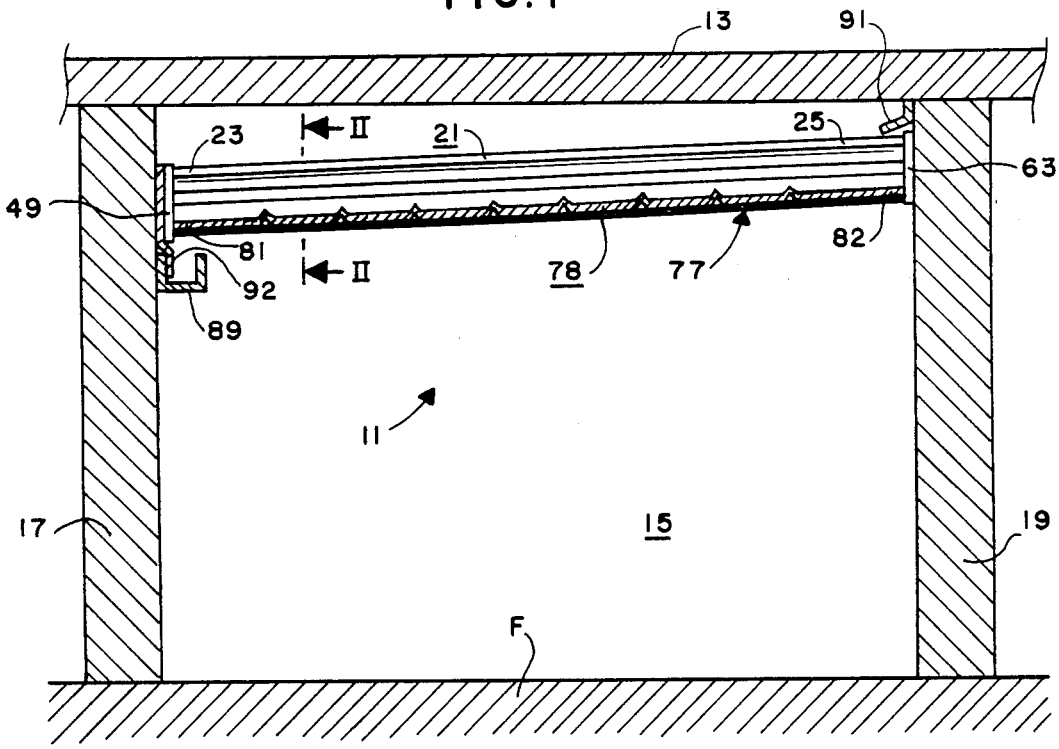
FIG. 1 is a somewhat diagrammatic sectional view of the leak-proof ceiling structure of the present invention shown associated with a building.

The preferred embodiment of the leak-proof ceiling structure 11 of the present invention is associated with a roof 13 of a building, or the like, to define a protected space 15 beneath the roof 13 and to prevent any liquid, such as water, which may leak through the roof 13 from passing to the protected space 15 (see FIG. 1). It should be noted that the term "roof" is used herein to mean any existing structure which covers the protected space 15 and may incude a typical fixed or suspended ceiling, or the like, as well as the outer roof structure of a building. Thus, the leak-proof ceiling structure 11 may be located directly below an existing ceiling in a multi-story building or a single story building having an attic or crawl space above the existing ceiling or may be located directly below the roof structure in a single story building without a typical ceiling and attic or crawl space. The protected space 15 is defined in part by a first wall 17, a second wall 19, and a floor F. More specifically, the leak-proof ceiling structure 11 extends between the first and second walls 17, 19 and the protected space 15 is located substantially between the first and second walls 17, 19 and beneath the leak-proof ceiling structure 11. Thus, the protected apace 15 may consist of a room of a building defined by the roof 13, first wall 17, second wall 19, floor F, a third wall 20, and a fourth wall (not shown) as will now be apparent to those skilled in the art.

Figure 2:
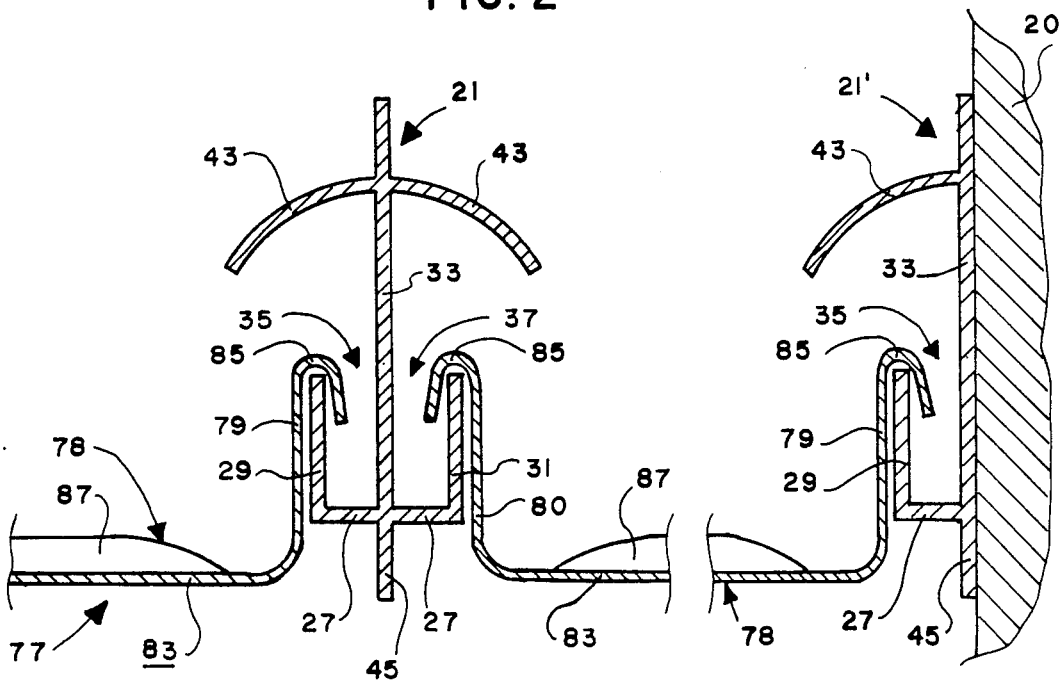
FIG. 2 is an enlarged sectional view substantially as taken on line II—II of FIG. 1 with portions thereof omitted for clarity.
Figure 3:
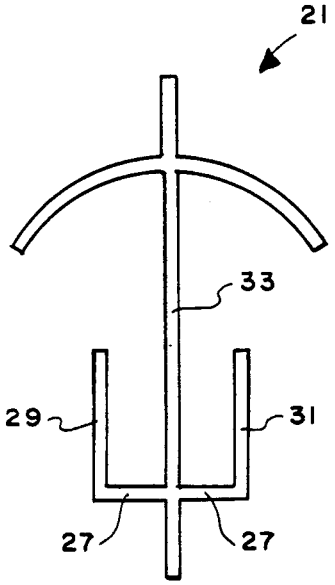
FIG. 3 is a left end elevational view of a longeron of the ceiling structure of the present invention.
Figure 4:
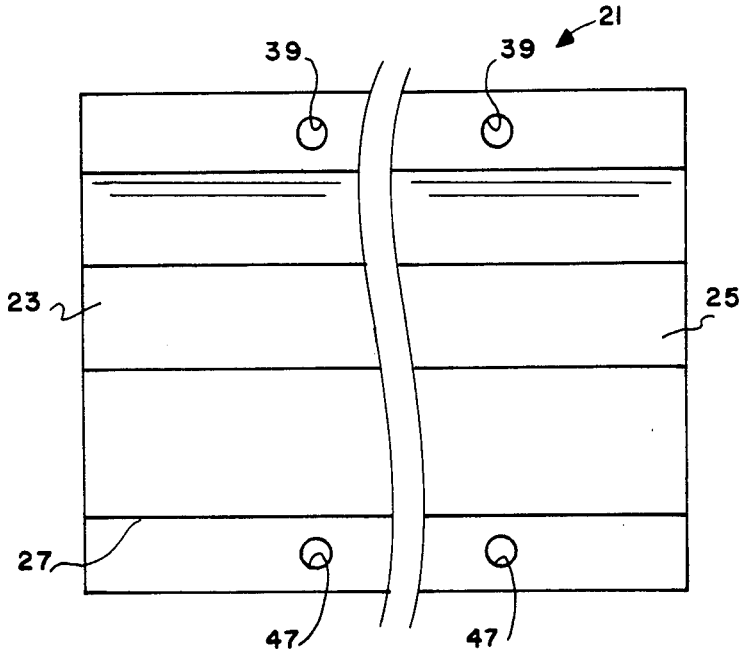
FIG. 4 is a side elevational view of the longeron of FIG. 3 with portions thereof broken away for clarity.

The leak-proof ceiling structure 11 includes at least a pair of longitudinal beams or longerons 21, 21' (see FIG. 2). The basic longeron 21 is shown in Figs. 2–4 and has a first end 23 and a second end 25. Each longeron 21 preferably includes an elongated bottom member 27, an elongated first side member 29 attached to one edge of the bottom member 27 and extending upwardly therefrom, and an elongated second side member 31 attached to the other edge of the bottom member 27 and extending upwardly therefrom. The bottom member 27 and side members 29, 31 coact to define a generally open-top square shaped channel or trough extending between the first and second ends 23, 25 of each longeron 21. Each longeron 21 preferably incudes an intermediate partition 33 attached to the bottom member 27 between the first and second side members 29, 31 and extending upwardly therefrom. The intermediate partition 33 divides the channel defined by the bottom member 27 and side members 29, 31 into a first channel 35 between the first side member 29 and the intermediate partition 33 and a second channel 37 between the second side member 31 and the intermediate partition 33. The intermediate partition 33 preferably extends above the upper edges of the first and second side members 29, 31 as clearly shown in FIGS. 2 and 3. One or more apertures 39 may be provided through the upper portion of the intermediate partition 33 (see FIG. 4) to allow the longerons 21 to be suspended from the roof 13 by wires, or the like, (not shown) as will now be apparent to those skilled in the art. Although the first and second channels 35, 37 can carry a small amount of liquid, each longeron 21 may include shield members 43 attached to either side of the intermediate partition 33 above the first and second channels 35, 37 for preventing large amounts of liquid from splashing into the first and second channels 35, 37. The shield members 43 may curve downwardly away from the respective intermediate partition 33 and may extend outward of the upper ends of the first and second side members 29, 31 as clearly shown in FIGS. 2 and 3. Each longeron 21 may include a downwardly extending fin 45 attached to the bottom member 27 substantially midway between the first and second side members 29, 31 in line with the intermediate partition 33 and extending the length thereof. One or more apertures 47 may be provided through the fin 45 (see FIG. 4) to allow typical suspended ceiling structure, fire suspression systems, or the like, (not shown) to be hung therefrom with wires, or the like, as will now be apparent to those skilled in the art. The specific construction, size and material of the longerons 21 may vary as will now be apparent to those skilled in the art. Thus, for example, each longeron 21 may be extruded out of aluminum, formed from sheet steel, etc.

The longerons 21' are similar to the basic longerons 21 but may be specifically constructed for placement adjacent a wall or the like (e.g., the third wall 20 as shown in FIG. 2). More specifically, the longerons 21' may be constructed with a cross sectional shape of half of the basic longerons 21 as clearly shown in FIG. 2 with identical components identified by like numerals. Such a construction allows the longerons 21 to be placed substantially directly against a wall or other structure as will now be apparent to those skilled in the art.

The leak-proof ceiling structure 11 includes suspension means for suspending the longerons 21 beneath the roof 13.

Figure 5:
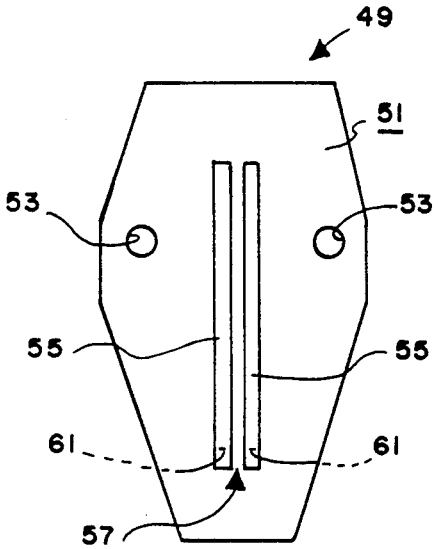
FIG. 5 is a front elevational view of a first bracket of the ceiling structure of the present invention.
Figure 6:
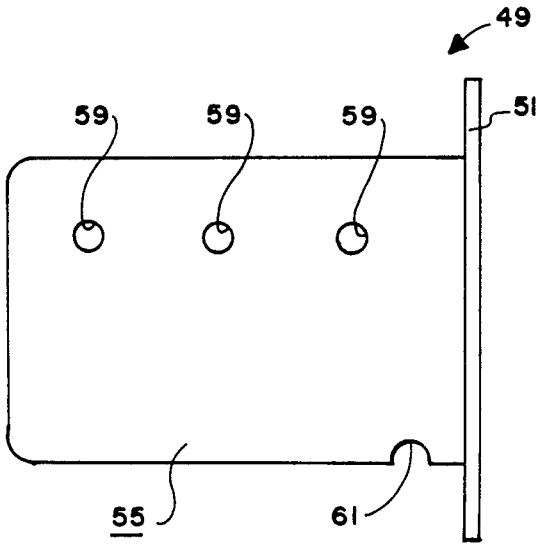
FIG. 6 is a side elevational view of the first bracket of FIG. 5.

The suspension means preferably includes a first bracket 49 (see, in general, FIGS. 5 and 6) for attaching the first end 23 of each of the longerons 21 to the first wall 17 with each of the longerons 21 spaced apart from the other. Each of the brackets 49 preferably includes a plate member 51 for fitting against and being secured to an upper portion of the first wall 17. More specifically, each plate member 51 may have one or more apertures 53 therethrough and screws, or the like, (not shown) may be used to fixedly secure the brackets 49 to the first wall 17. Each of the first brackets 49 preferably includes a pair of spaced-apart arms 55 attached to the plate member 51 and extending outwardly therefrom. The arms 55 are spaced from one another a distance slightly greater than the thickness of the intermediate partition 33 of the longerons 21 to define a slot 57 into which the intermediate partition 33 of the longerons 21 can be inserted. Apertures 59 may be provided through the arms 55 to allow screws, or the like, (not shown) to pass therethrough into the intermediate partition 33 of a longeron 21 and to securely attach the longeron 21 to the bracket 49. A transverse groove 61 is preferably provided across the lower edge of each arm 55 at a point adjacent the plate member 51 for reasons which will hereinafter become apparent. The specific construction, size and material of the brackets 49 may vary as will now be apparent to those skilled in the art. Thus, for example, each bracket 49 may be formed from sheet steel, etc.

Figure 7:
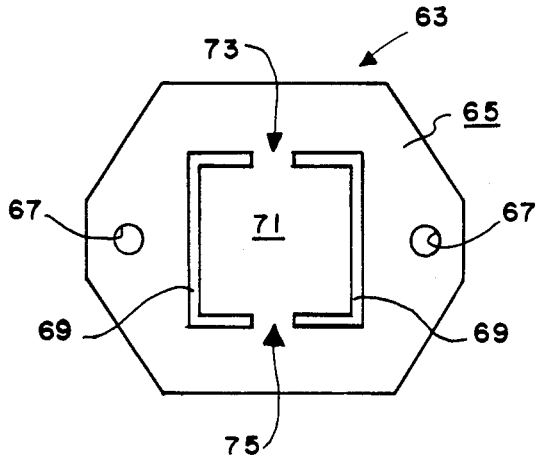
FIG. 7 is a front elevational view of a second bracket of the ceiling structure of the present invention.
Figure 8:
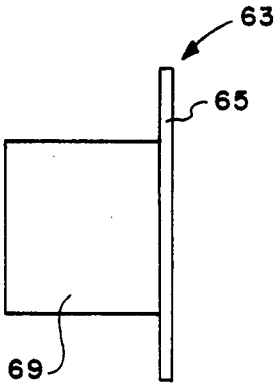
FIG. 8 is a side elevational view of the second bracket of FIG. 7.

The suspension means also preferably includes a second bracket 63 (see, in general, FIGS. 7 and 8) for attaching the second end 25 of each of the longerons 21 to the second wall 19 with each of the longerons 21 spaced apart from the other. Each of the brackets 63 preferably includes a plate member 65 for fitting against and being secured to an upper portion of the second wall 19. More specifically, each plate member 65 may have one or more apertures 67 therethrough and screws, or the like, (not shown) may be used to fixedly secure the brackets 63 to the second wall 19. Each of the brackets 63 preferably includes a pair of arms 69 attached to the plate member 65 and extending outwardly therefrom. The arms 69 are respectively shaped for each to receive a portion of the bottom member 27 and one of the side members 29, 31 of one of the longerons 21. More specifically, the arms 69 are preferably shaped so as to coact to define a square cavity 71 having an upper slot 73 and a lower slot 75. The square cavity 71 is slightly larger in size than the open-top square defined by the bottom member 27 and side members 29, 31 of each longeron 21 for slidably receiving the longeron 21 with the intermediate partition 33 extending into the upper slot 73 and with the fin 45 extending into the lower slot 75. The specific construction, size and material of the brackets 63 may vary as will now he apparent to those skilled in the art. Thus, for example, each bracket 63 may be extruded out of aluminum, formed from sheet steel, etc.

Figure 9:
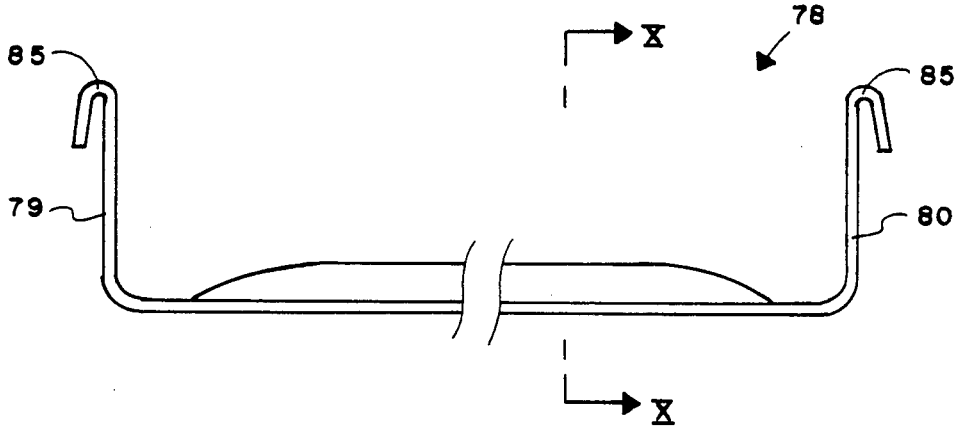
FIG. 9 is a left end elevational view of a trough means of the ceiling structure of the present invention with portions the broken away for clarity.
Figure 10:
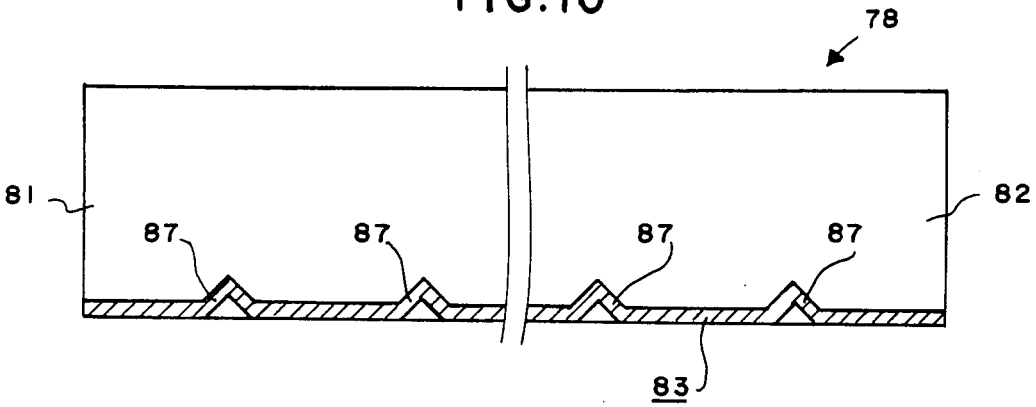
FIG. 10 is a sectional view as taken on line X—X of FIG. 9 with portions thereof broken away for clarity.

The leak-proof ceiling structure 11 includes a trough means 77 suspended from the longerons 21 for catching any liquid that may leak from the roof 13 and for conveying any such liquid away from the protected space 15. The trough means 77 preferably includes one or more elongated trough members 78 (see, in general, FIGS. 9 and 10) for being suspended from and between adjacent longerons 21. Each trough member 78 preferably has elongated first and second sides 79, 80, respectively, for being coupled to adjacent longerons 21; first and second ends 81, 82, respectively, for being positioned adjacent the first and second walls 17, 19, respectively; and a substantially flat bottom member 83 extending between the sides 79, 80. Each side 79, 80 preferably includes an elongated hook portion 85 for hooking over the upper end of the respective side member 29, 31 of the respective longeron 21 as clearly shown in FIG. 2. The specific construction, size and material of the trough members 78 may vary as will now be apparent to those skilled in the art. Thus, for example, the trough members 78 may be bent or otherwise formed from sheet steel, etc. Ridges 87 may be pressed or otherwise provided in the bottom member 83 of the trough members 78 to give lateral stiffness to the trough members 78 as will now be apparent to those skilled in the art. The ridges 87 are preferably formed "up" so as not to collect liquid as will now be apparent to persons skilled in the art.

The leak-proof ceiling structure 11 preferably includes gutter means 89 for being positioned directly beneath the first end 23 of the longerons 21, 21' and the first end 81 of the trough members 78 (see FIG. 1). Any liquid that does leak from the roof 13 will pass from the longerons 21 or trough members 78 into the gutter means 89 and will be directed to a drain or the like. The gutter means 89 may be of any typical construction now apparent to those skilled in the art.

The use and operation of the leak-proof ceiling structure 11 is quite simple. The width of the protected space 15, longerons 21 and trough members 78 will determine the number of longerons 21 and trough members 78 needed to provide full protection. The necessary number of longerons 21 are then suspended from the roof 13 with the first end 23 thereof lower than the second end 25 thereof to cause any liquid that may enter the channels 35, 37 to run to the first end 23 as will now be apparent to those skilled in the art. The longerons 21 are preferably suspended from the roof 13 via the brackets 49, 63. Thus, the necessary number of first brackets 49 are attached to the first wall 17 at spaced locations depending on the width of the trough members 78 to be used. For example, the brackets 49 may be spaced on 24 inch centers. A second bracket 63 is attached to the second wall 19 opposite each first bracket 49. Longerons 21 are then attached to opposite ones of the brackets 49, 63 by, for example, slidably inserting the intermediate partition 33 of the first end 23 of each longeron 21 into a slot 57 in a bracket 49 until the second end 25 of the longeron 21 can be positioned in front of the square cavity 71 of the opposite bracket 63. The second end 25 of the longeron 21 is then slid or inserted into the square cavity 71 until the open-top square formed by the bottom and side members 27, 29, 31 of the longeron 21 is supported by the arms 69 of the bracket 63 while the first end 23 thereof remains within the slot 57. Screws, or the like, (not shown) are then inserted through the apertures 59 to secure the first end 23 of the longeron 21 to the bracket 49. After at least an adjacent pair of longerons 21 are so positioned, at least one trough member 78 is secured thereto by merely positioning the flanges or hook portions 85 of the opposite sides 79, 80 thereof over the upper ends of the respective side members 29, 31 of the adjacent longerons 21. It should be noted that wires, or the like, may be secured to the upper portion of the intermediate partition 33 of each longeron 21 via the apertures 39, and anchored to the roof 13 to suspend or provide added support for the longerons 21 and associated structure especially in the event of extremely long spans between the first and second walls 17, 19 as will now be apparent to those skilled in the art. The second brackets 63 are preferably secured to the second wall 19 in a position relative to the first brackets 49 so as to position the second end 25 of each longeron 21 higher vertically than the first ends 23 thereof, and consequently to position the second end of each trough member 78 higher than the first end thereof, whereby any liquid that might leak through the roof 13 will fall onto either a longeron 21 or a trough member 78 and will run toward the first wall 17. The gutter means 89 is preferably attached to the first wall 17 directly beneath the first brackets 49 and the first end 81 of the trough members 78. Flashing 91 (see FIG. 1) may be attached to the wall 19 to direct any liquid leaking from roof 13 into a trough member 78 or longeron 21 as will now be apparent to those skilled in the art. Flashing 92 may be attached to the wall 17 with the same fasteners securing brackets 49 to direct my liquid running down the wall 17 into the gutter means 89. It should be noted that rather than being separate from the gutter means 89, the flashing 92 may be integral therewith. That is, the gutter mean 89 could be constructed with unequal sides and could be mounted with the longer side mounted against the wall 17 and extending between the wall 17 and the brackets 49 to serve as the flashing 92 as will now be apparent to those skilled in the art. The transverse grooves 61 in the arms 55 of the first brackets 49 will cause liquid that may run down the arm 55 toward the plate member 51 to drop into the gutter means 89 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A leak-proof ceiling structure for being associated with a roof to define a protected space beneath said roof and to prevent any liquid which may leak through said roof from passing to said protected space, said leak-proof ceiling structure comprising;

(a) a pair of elongated longerons, each longeron having a first end and a second end;

(b) suspension means for suspending said longerons beneath said roof with each of said longerons spaced apart from the other with said second end of said longerons higher than said first end thereof;

(c) elongated trough means for being suspended between said pair of longerons and for catching liquid that may leak from said roof; and wherein each of said longerons further comprises a fin having means for attaching a suspended ceiling therefrom.

2. The ceiling structure of claim 1 in which each of said longerons includes a channel for catching liquid that may leak from said roof.

3. The ceiling structure of claim 2 in which is included gutter means for receiving any liquid caught by said longerons and said trough means and for conveying such liquid from said protected space.

4. A leak-proof ceiling structure for being associated with a roof to define a protected space beneath said roof from passing to said protected space, said leak-proof ceiling structure comprising;

(a) a pair of longerons, each of said longerons having a first end and a second end;

(b) a pair of first brackets, each of said first brackets attaching said first end of one of said longerons to a first wall with each of said longerons spaced apart from the other;

(c) a pair of second brackets, each of said second brackets attaching said second end of one of said longerons to a second wall with each of said longerons spaced apart from the other;

(d) trough means for being suspended between said pair of longerons and for catching any liquid that may leak from said roof and for conveying any such liquid away from said protected space; and wherein each of said longerons further comprises a fin having means for attaching a suspended ceiling therefrom.

5. The leak-proof ceiling structure of claim 4 in which each of said longerons includes an elongated bottom member, an elongated first side member attached to one edge of said bottom member and extending upwardly therefrom, and an elongated second side member attached to the other edge of said bottom member and extending upwardly therefrom; each of said wall members having an upper edge.

6. The leak-proof ceiling structure of claim 5 in which said trough means has elongated first and second side edges for being coupled to opposing ones of said wall members of said longerons.

7. The leak-proof ceiling structure of claim 6 in which each of side edges of said trough includes an elongated hook portion for hooking over the upper end of the respective ones of said wall members of said longerons.

8. The leak-proof ceiling structure of claim 7 in which said first end of each of said longerons is secured to said first wall in a higher vertical position than said second end of each of said longerons to cause any liquid caught by said trough means to flow toward said second wall.

9. The leak-proof ceiling structure of claim 5 in which said bottom member, said first side member and said second side member of each of said longerons form a channel for catching liquid.

10. The leak-proof structure of claim 9 in which each of said longerons includes a shield member positioned above said channel thereof.

11. The leak-proof structure of claim 9 in which each of said longerons includes an intermediate partition attached to said bottom member thereof between said first and second side members thereof and extending upwardly therefrom for dividing said channel thereof into first and second channels.

12. The leak-proof ceiling structure of claim 11 in which each of said longerons includes a shield member attached to either side of said intermediate partition thereof above said first and second channels.

13. The leak-proof ceiling structure of claim 12 in which each of said shield members curve downward away from said intermediate partition.

* * * * *